United States Patent [19]

Nishishita

[11] Patent Number: 5,076,354

[45] Date of Patent: Dec. 31, 1991

[54] MULTIFLOW TYPE CONDENSER FOR CAR AIR CONDITIONER

[75] Inventor: Kunihiko Nishishita, Saitama, Japan

[73] Assignee: Diesel KiKi Co., Ltd., Tokyo, Japan

[21] Appl. No.: 512,156

[22] Filed: Apr. 20, 1990

[30] Foreign Application Priority Data

Apr. 26, 1989 [JP] Japan ..... 1-107077

[51] Int. Cl.[5] ..... F28F 13/08

[52] U.S. Cl. ..... 165/146; 165/153; 165/173; 165/174

[58] Field of Search ..... 165/152, 153, 174, 146, 165/173

[56] References Cited

U.S. PATENT DOCUMENTS

| | | | |
|---|---|---|---|
| 4,201,263 | 5/1980 | Anderson | 165/146 |
| 4,332,293 | 6/1982 | Hiramatsu | 165/153 |
| 4,469,168 | 9/1984 | Itoh et al. | 165/152 |
| 4,693,307 | 9/1987 | Scorselletta | 165/152 |
| 4,825,941 | 5/1989 | Hoshino et al. | 165/110 |

*Primary Examiner*—Allen J. Flanigan
*Attorney, Agent, or Firm*—Kanesaka & Takeuchi

[57] ABSTRACT

Here is disclosed a heat exchanger of the multiflow type comprising a plurality of flat tubes and corrugated fins stacked together one on another alternately, an inlet header pipe to which said flat tubes are connected at their one ends, an outlet header pipe to which said flat tubes are connected at their other ends, and partitions provided within said respective header pipes so that a flow of refrigerant folded plural times in zigzag fashion is established along a purality of paths defined between the two header pipes, wherein the corrugated fins and the flat tubes are previously dimensioned within the respective optimal ranges and the number of the paths as well as the numbers of the flat tubes defining the respective paths are also optimally selected so that the passage resistance of the refrigerant and the flow resistance of the cooling air may be effectively reduced while improving the heat exchanging efficiency, and thereby a heat exchanger having a totally high reliability may be obtained.

2 Claims, 6 Drawing Sheets

MULTIFLOW TYPE CONDENSER FOR CAR AIR CONDITIONER

BACKGROUND OF THE INVENTION

1. Field of the Invention

This invention relates to a heat exchanger of multiflow type such as the one embodied in the form of a condenser.

2. Prior Art

The heat exchanger of the parallel flow type such as the one embodied in the form of a condenser conventionally comprises a plurality of flat tubes and corrugated fins stacked together one on another alternately, an inlet header pipe to which said flat tubes are connected at the one ends thereof and an outlet header pipe to which said flat tubes are connected at the other ends thereof. It is also well known to provide said respective header pipes therein with partitions so that a flow of refrigerant folded plural times in zigzag fashion (multiflow type) is established along a plurality of paths defined between the two header pipes at a heat exchanging efficiency higher than that as achieved by the usual heat exchanger of serpentine type, advantageously reducing the required quantity of refrigerant (e.g., Japanese Patent Application Disclosure Gazettes Nos. 1988-34466; and 1988-243688).

However, it has been, difficult even in such improved heat exchanger of multiflow type to improve the overall performance of the heat exchanger even when respective designing factors are separately preset because the flow resistance of cooling air and the heat radiation value, on one hand, and the passage resistance of refrigerant and the heat exchanging efficiency, on the other hand, are closely related to each other.

Accordingly, it is a principal object of the invention to provide a condenser which enables the overall performance thereof to be improved.

SUMMARY OF THE INVENTION

The object set forth above is achieved, according to the invention, by providing a condenser of the multiflow type including a plurality of flat tubes and corrugated fins stacked together one on another alternately, an inlet header pipe to which said flat tubes are connected at the one ends thereof, an outlet header pipe to which said flat tubes are connected at the other ends thereof, and partitions provided within said respective header pipes so that a flow of refrigerant folded plural times in zigzag fashion is established along a plurality of paths defined between the two header pipes, characterized in that a) each of said corrugated fins has a height B in a range of B=7 to 10 mm;

b) each of said corrugated fins has a width C in a range of C=14 to 25 mm as measured in the direction parallel to an air flow;

c) each of said corrugated fins has a wall thickness D in a range of D=0.12 to 0.14 mm;

d) each of said corrugated fins has a pitch E, which corresponds to a distance between each pair of adjacent corrugations, in a range of E=2.0 to 4.0 1 mm;

e) each of said flat tubes has a height F in a range of F=1.5 to 2.5 mm;

f) each of said flat tubes has a width G in a range of G=12 to 23 mm as measured in the direction parallel to the air flow;

g) there are defined said paths the number $P_s$ of which is in a range of $P_s$=3 to 6; and h) the numbers of flat tubes in said respective paths are decreased from the most upstream side to the most downstream side approximately by the same number and the number of tubes defining the most upstream path is approximately twice the number of the tubes defining the most downstream path.

The other features, objects and advantages of the invention will be apparent from the following description of a preferred embodiment in reference with the accompanying drawings.

BRIEF DESCRIPTION OF THE DRAWINGS

FIGS. 1 through 11 illustrate an embodiment of the invention, in which:

FIG. 1 is a front view of the condenser;

FIG. 2 is a sectional view of the header pipe taken along a line II—II in FIG. 1;

FIG. 3 is a sectional view taken along a line III—III in FIG. 2;

FIG. 4 is a side view of the flat tubes and the corrugated fins illustrated in FIG. 3;

FIG. 5 is a graphic diagram of the flatness versus the passage resistance;

FIG. 6 is a graphic diagram of the fin height versus the heat exchanging efficiency;

FIG. 7 is a graphic diagram of the fin width versus the heat exchanging efficiency;

FIG. 8 is a graphic diagram of the fin wall thickness versus the heat exchanging efficiency;

FIG. 9 is a graphic diagram of the fin pitch versus the heat exchanging efficiency;

FIG. 10 is a graphic diagram of the tube height versus the heat exchanging efficiency; and FIG. 11 is a graphic diagram of the number of paths versus the passage resistance.

DETAILED DESCRIPTION OF THE PREFERRED EMBODIMENT

Figure 1:
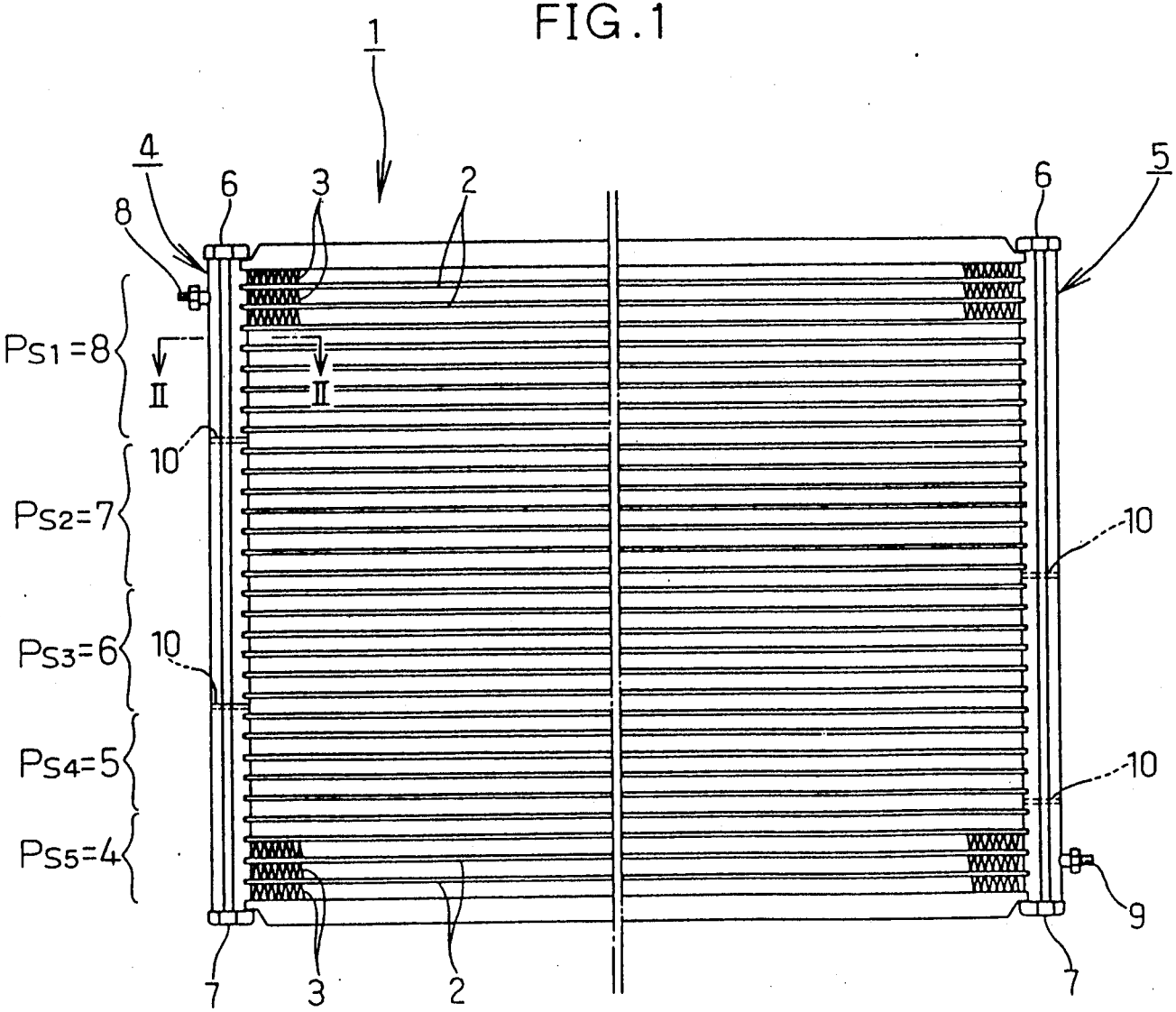

A heat exchanger or condenser 1 according to this embodiment comprises, as shown by FIG. 1, a plurality of flat tubes 2 and corrugated fins 3 stacked together one on another alternately, an inlet header pipe 4 to which these flat tubes 2 are connected at the one ends thereof and an outlet header pipe 5 to which said flat tubes are connected at the other ends thereof. The respective header pipes 4, 5 have their vertically opposite ends closed by blind caps 6, 7 respectively. An inlet joint 8 is connected to the inlet header pipe 4 adjacent its upper end and an outlet joint 9 is connected to the outlet header pipe 5 adjacent its lower end. Both the inlet and outlet header pipes 4, 5 contain therein partitions 10 adapted to define a plurality of paths each defined by a plurality of the flat tubes 2 (multiflow type). In this embodiment, there are defined such paths of which the number $P_s$=5. Thus, the invention provides the or condenser of multiflow type in which a flow of refrigerant folded plural times in zigzag fashion is established along a plurality of the paths $P_{s1}$ to $P_{s5}$ between the inlet joint 8 and the outlet joint 9.

Figure 2:
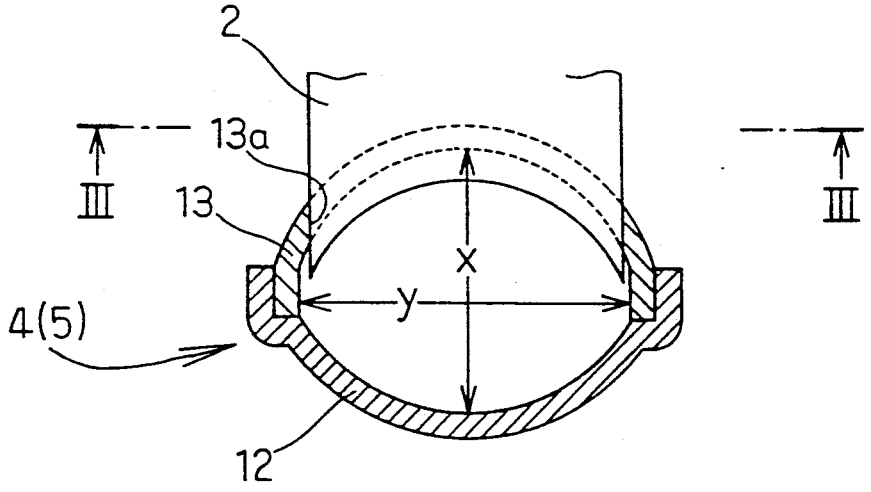

Each of said header pipes 4, 5 consists of, as shown by FIG. 2 in cross-section, a tank 12 and an end plate 13 both circularly curved in cross-section so that the both components form together an elliptical cross-section defined by a minor diameter x and a major diameter y. Each end plate 13 is formed with a plurality of tube insertion holes 13*a* into which the ends of the respective flat tubes 2 are inserted and connected integrally with the end plate 13 by brazing.

Various factors such as a flatness A of the respective header pipes 4, 5, a height B, a width C, a wall thickness D and a pitch E of the corrugated fin 3, a height F and a width G of the flat tube 2, the number $P_s$ of the paths and the number of the tubes 2 defining the respective paths are selected as will be described below.

The flatness A of the respective header pipes 4, 5 is defined by a ratio of the minor diameter x (i.e., a depth dimension of the pipe interior and referred to also as a pipe height) to the major diameter y of the elliptical cross-section as illustrated by FIG. 2, namely, x/y. The flatness A is preferably selected within a range of 0.65 to 0.8 and this specific embodiment adopts A=0.8.

Figure 5:
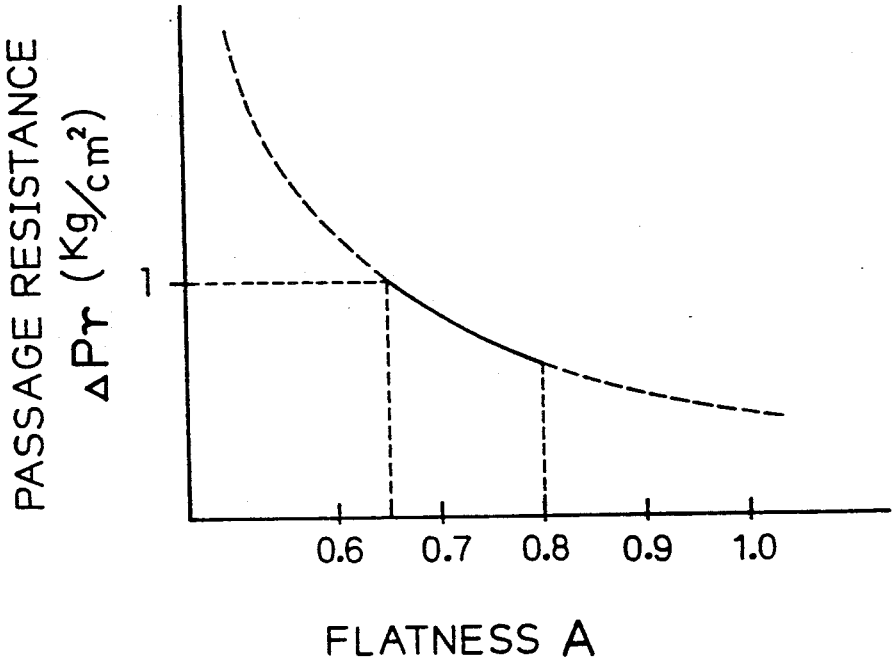

The above-mentioned range of the flatness A is selected in view of a relationship between the refrigerant passage resistance $\Delta P_r$ and the refrigerant saving effect. More specifically, the flatness A is related to the refrigerant passage resistance $\Delta P_r$ as indicated by a characteristic curve of FIG. 5 and this characteristic curve suggests that the passage resistance $\Delta P_r$ should be preferably less than 1(kg/cm$^2$) at the minimum value of the flatness A. Such requirement determines the minimum value of A=0.65. Such value of the passage resistance $\Delta P_r$ less than 1(kg/cm$^2$) is also required for construction of the heat exchanger in general. The maximum value of the flatness A, on the other hand, is given in consideration of a fact that the smaller the flatness A, the smaller the refrigerant capacity within the flat tube. Specifically, the above-mentioned maximum value of A=0.8 is selected so as to achieve the refrigerant saving effect with a limit value of the refrigerant capacity in the order of ⅔ with respect to the heat exchanger of serpentine type having a similar performance, for example, 400 mm$^3$.

Figure 3:
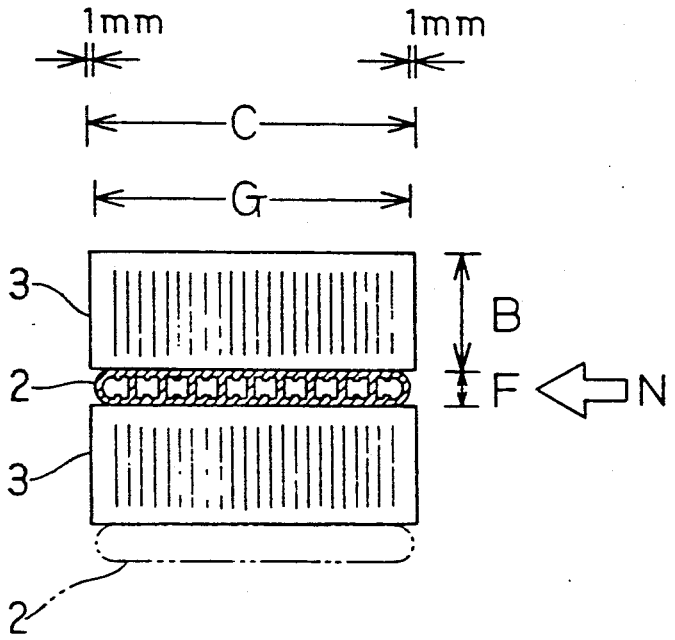
Figure 4:
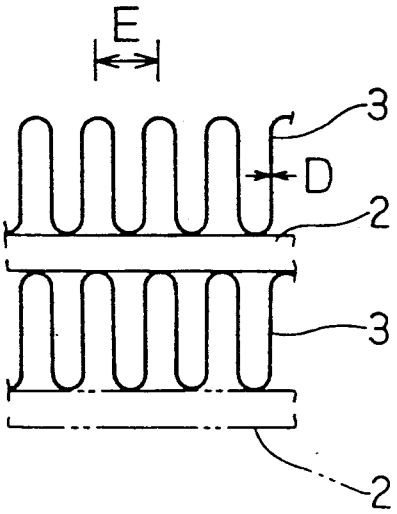

The height B of the corrugated fin 3 corresponds, as shown by FIGS. 3 and 4, to the distance between each pair of the adjacent tubes 2 and is preferably 7 to 10 mm. In this specific embodiment, B=8 mm. Such a range is selected in view of the relationship between the fin height B and the heat exchanging efficiency Q of the heat exchanger 1 as indicated by the characteristic curve of FIG. 6. Thus, said range is selected so as to achieve 90% or higher of the maximum value $\alpha$ of the efficiency Q. The efficiency Q(Kcal/h m$^2$) is expressed by the ratio of the heat radiation value Ha(Kcal/h) to the flow resistance $\Delta P_a$(mm Ag) of cooling air flowing through the heat exchanger, i.e., $Q=Ha/\Delta P_a$. In other words, the higher the air flow resistance $\Delta P_a$, the lower the heat exchanging efficiency Q.

Figure 7:
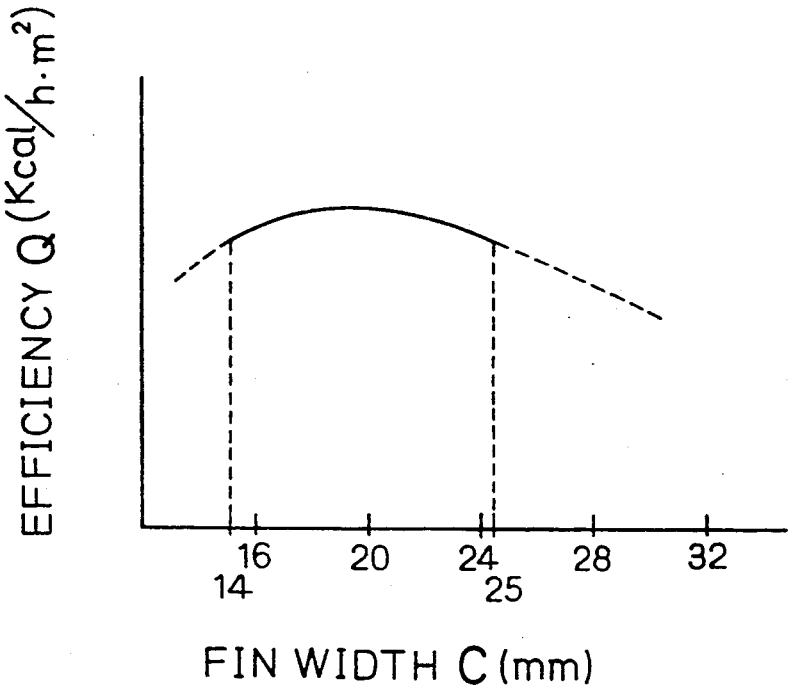

The width C of the fin 3 is a dimension as measured along the flowing direction of the cooling air indicated by an arrow N in FIG. 3 and is preferably selected within a range of C=14 to 25 mm. In this specific embodiment, C=20 mm. Such a range is selected in view of the relationship between the fin width C and the efficiency Q of the heat exchanger as indicated by the characteristic curve of FIG. 7 and so as to achieve 90% or higher of the maximum efficiency Q.

Figure 8:
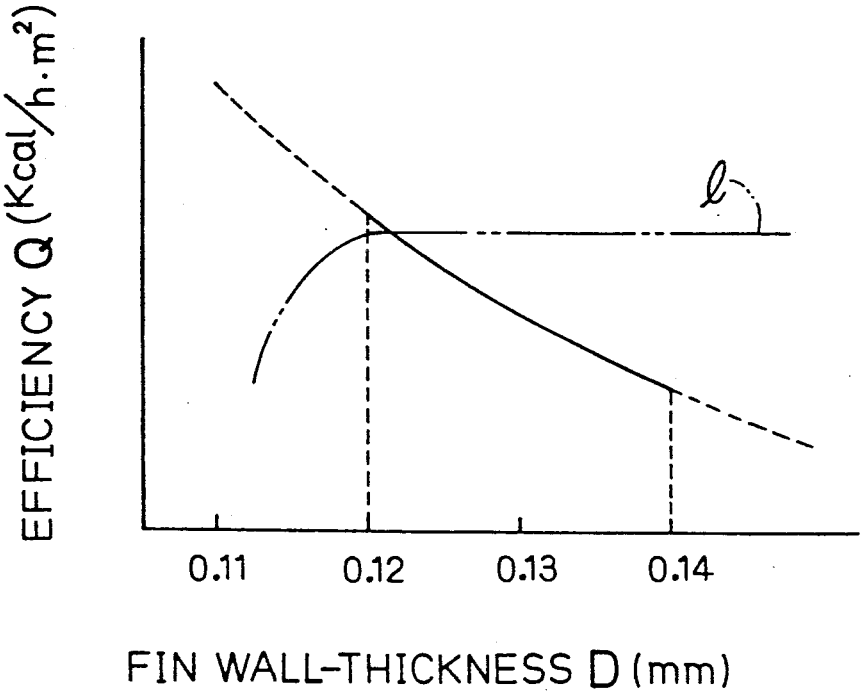

The wall thickness D of the fin 3 is preferably selected within a range of D=0.12 to 0.14 mm and, in this specific embodiment, D=0.13 mm. Such range is selected in consideration of the relationship between the wall thickness D and the efficiency Q of the heat exchanger as indicated by the characteristic curve of FIG. 8. Although this characteristic curve suggests that the wall thickness D should be preferably as small as possible, an installation stability curve 1 suggests that the installation stability is sharply lowered as the wall thickness D decreases beyond 0.12 mm. Thus, the range of the wall thickness D is selected as indicated above.

Figure 9:
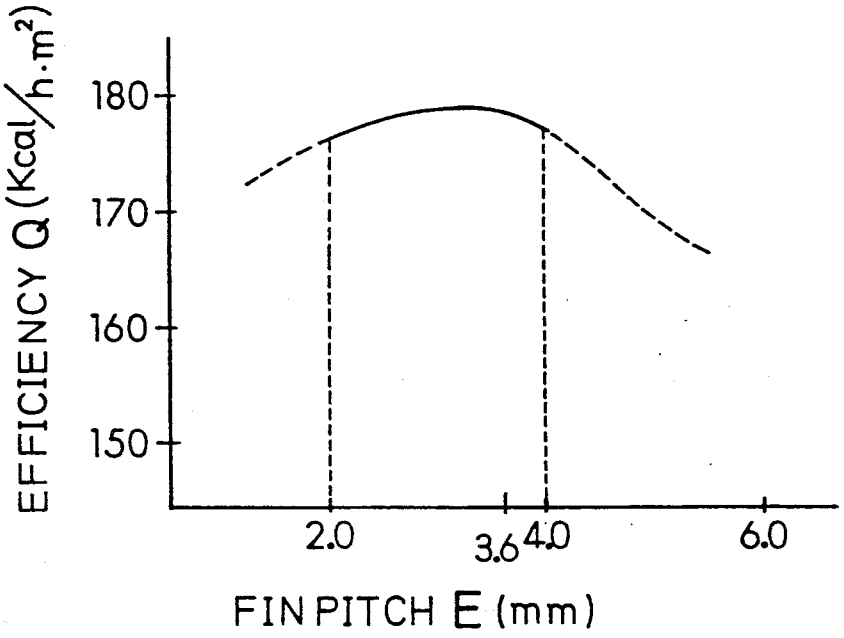

The pitch E of the fin 3 is a distance between each pair of the adjacent corrugations as shown by FIG. 4 and preferably selected within a range of E=2.0 to 4.0 mm. In this specific embodiment, E=3.6 mm. Such range is selected on the basis of a relationship between the fin pitch E and the efficiency Q of the heat exchanger as indicated by the characteristic curve of FIG. 9 and so as to achieve 90% or higher of the maximum efficiency Q.

Figure 6:
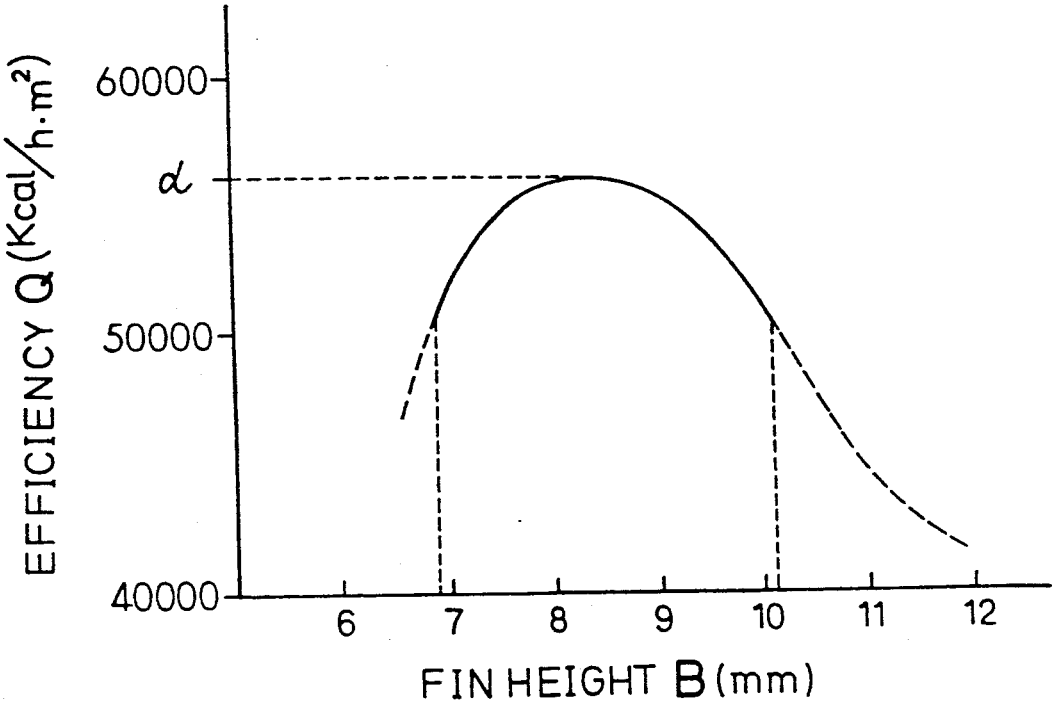
Figure 10:
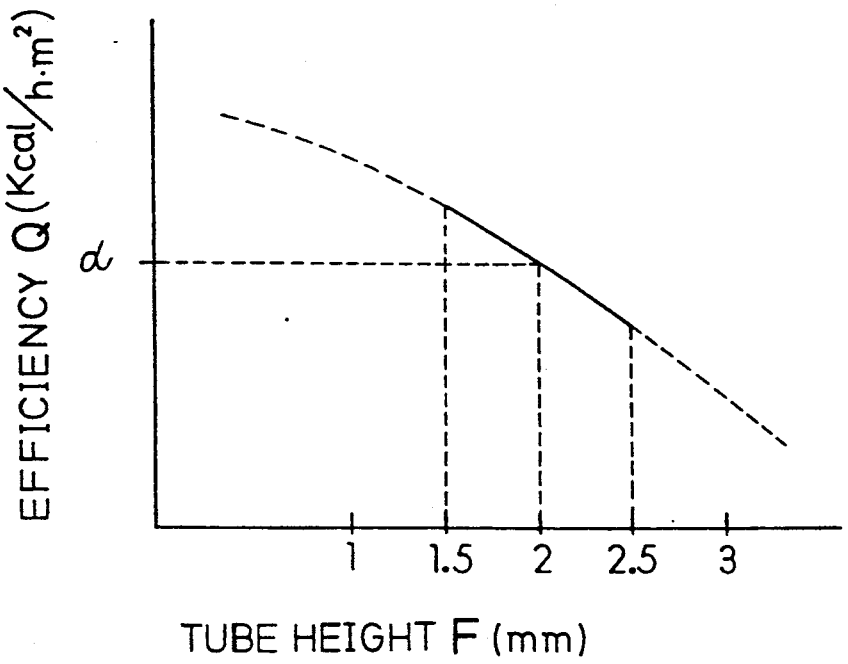

The height F of the flat tube 2 is, as shown by FIGS. 3 and 4, a dimension as measured in the direction of stacking and preferably selected within a range of F=1.5 to 2.5 mm. In this specific embodiment, F=2 mm. Such a range is selected on the basis of the relationship between the tube height F and the efficiency Q of the heat exchanger as indicated by the characteristic curve of FIG. 10. This characteristic curve suggests that the tube height F of less than 1.5 mm would make mass production of the tubes 2 by extrusion very difficult and, therefore, the minimum value should be F=1.5 mm. The characteristic curve suggests also that the maximum value $\alpha$ of the efficiency Q (Kcal/h m$^2$) as shown in FIG. 6 is achieved with the tube height F=2.0 mm. Thus, the maximum F=2.5 mm is selected with respect to the central value of the tube height F=2.0 mm, as shown by FIG. 10.

The width G of the flat tube 2 is, as shown by FIG. 3, a dimension as measured along the direction in which the cooling air flows through the tube 2 and preferably selected within a range of G=12 to 23 mm. In this specific embodiment, G=18 mm. This tube width G is defined as the dimension corresponding to the above-mentioned fin width minus 2 mm, i.e., minus 1 mm at opposite edges thereof. The tube width G is dimensioned in this manner because, if the tube width G is larger than the fin width C, the opposite edges of the tube 2 would extend beyond the fin 3 and be susceptible to be damaged while the tube width G excessively narrow would deteriorate the efficiency Q of the heat exchanger. The range of the tube width G as set forth above avoids both the possibilities.

Figure 11:
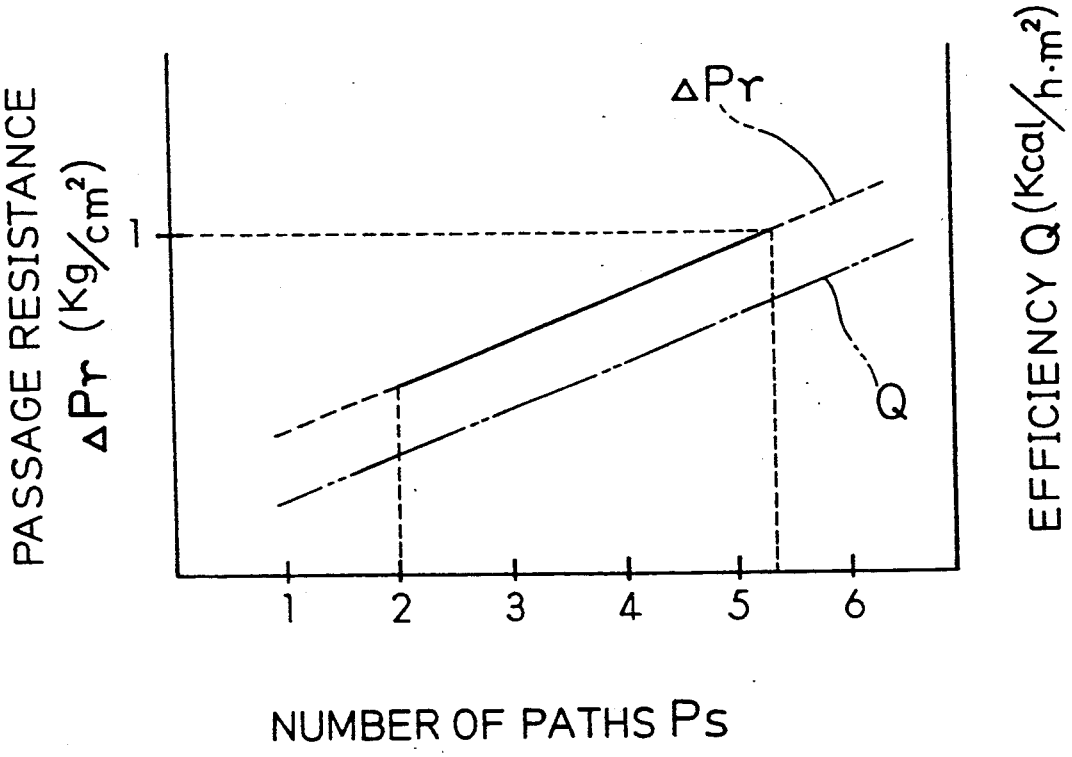

The paths respectively comprise a plurality of the flat tubes 2 defined by the partitions 10 and the number $P_s$ of such paths is preferably selected within a range of $P_s=3$ to 6. In this specific embodiment, $P_s=5$, as shown by FIG. 1. The range of 3 to 6 is selected on the basis of the relationship between the number $P_s$ of the paths and the efficiency Q of the heat exchanger as indicated by the characteristic curve of FIG. 11. This characteristic curve suggests that the efficiency Q is increased as the number $P_s$ of the paths is increased and the range of $P_s=3$ to 6 assures a sufficient level of the efficiency Q with the passage resistance $\Delta P_r$ less than 1.

The number of the flat tubes 2 constituting each path is selected so that the flat tubes 2 gradually decrease substantially by the same number from the most upstream side to the most downstream side and the number of the flat tubes 2 constituting the first and upper most path on the inlet side is substantially twice the number of flat tubes constituting the last and lowermost path on the outlet side. For example, there are provided five paths in this specific embodiment and, as shown by FIG. 1, the numbers of the flat tubes constituting the respective paths $P_s$ to $P_{s5}$ are 8, 7, 6, 5 and 4, respectively, namely, the number of the flat tubes successively decreases by one toward the most downstream side so that the number of the flat tubes constituting the first path $P_{s1}$ is twice the number of the flat tubes constituting the last and fifth path $P_{s5}$.

Such arrangement is based on a fact that, generally in the heat exchanger such as the condenser, the refrigerant enters into the heat exchanger in gaseous state of a relatively large volume and exits the heat exchanger in substantially liquidified state of a relatively small volume. More specifically, during passage through the heat exchanger, the refrigerant is condensed from the gaseous state into the gas/liquid two-phase state as the heat exchange occurs within the heat exchanger and, in consequence, a required volume of the refrigerant gradually decreases, namely, the required number of the flat tubes also correspondingly decreases. Experience has revealed that, preferably, the flat tubes defining each path is successively decreased by the same number from the most upstream side to the most downstream side. It has been also experimentally found that, preferably, the number of the flat tubes defining the outlet path is substantially a half with respect to the flat tubes defining the inlet path and excessively decreasing the number of the flat tubes defining said outlet path would result in an excessive throttling effect and a disadvantageous increase of the passage resistance.

As will be apparently understood from the foregoing description, the illustrated embodiment of the invention comprises the corrugated fins and the flat tubes previously dimensioned within the respective optimum ranges and the number of the paths as well as the numbers of the flat tubes defining the respective paths which are also optimally selected so that the passage resistance of the refrigerant and the flow resistance of the cooling air can be reduced while improving the heat exchanging efficiency and thereby a heat exchanger having a totally high reliability is obtained.

It should be understood that, although the specific embodiment including five paths has been described and illustrated hereinabove, another embodiment of four paths arrangement is also possible, which comprises, from the most upstream side to the most downstream side, $P_{s1}=12$, $P_{s2}=10$, $P_{s3}=8$, and $P_{s4}=6$.

According to the invention, the respective dimensional ranges of the fin height B, the fin width C, the fin wall thickness D, the fin pitch E, the tube height F and the tube width G are selected in consideration of the flow resistance of cooling air as well as the heat radiation value, on one hand, and the number of the path $P_s$ and the number of the flat tubes defining each path are distributed in consideration of the passage resistance of refrigerant as well as the heat exchanging efficiency so that the heat exchanging performance can be totally improved while reducing said flow resistance as well as said passage resistance of heat exchanger.

What is claimed is:

1. A multiflow type condenser for a car air conditioner, comprising:

a pair of headers provided in parallel with each other;

a plurality of flat tubes each connected to said headers at opposite ends thereof;

a plurality of corrugated fins provided in air paths between said flat tubes;

at least two partitions provided within said headers, one for each header, so that said flat tubes are divided into at least three passes; i.e., top, middle, and bottom passes;

said corrugated fins each having a width of 14 to 25 mm as measured along a direction of said air paths and a wall thickness of 0.12 to 0.14 mm, said flat tubes each having a width of 12 to 23 mm as measured along said air path direction and decreasing by a constant number from said top pass to said bottom pass such that the number of flat tubes in said top pass is about twice that of said bottom pass; and said headers having an elliptical cross-section with a ratio of its minor diameter to its major diameter ranging from 0.65 to 0.80.

2. A multiflow type condenser for a car air conditioner, comprising:

a pair of headers provided in parallel with each other;

a plurality of flat tubes each connected to said headers at opposite ends thereof and divided into at least three parallel compartments;

a plurality of corrugated fins provided in air paths between said flat tubes;

a least two partitions provided within said headers, one for each header, so that said flat tubes are divided into at least three passes; i.e., top, middle, and bottom passes;

the difference between the width (G) of said flat tubes and a major diameter (Y) of said headers is sufficiently large to permit a flow of brazing material along either front edge of said flat tube;

said flat tubes decreased by a constant number from said top pass to said bottom pass such that the number of flat tubes in said top pass is about twice that of said bottom pass; and said headers have an elliptical cross-section with a ratio of its minor diameter to its major diameter falling in a range between 0.65 and 0.80.

* * * * *